US006520543B1

(12) United States Patent
Hoar

(10) Patent No.: US 6,520,543 B1
(45) Date of Patent: Feb. 18, 2003

(54) STATIC CLING WINE INFORMATION LABEL AND USE

(76) Inventor: Bruce E. Hoar, 56 Main St., Stonybrook, NY (US) 11790

( * ) Notice: Subject to any disclaimer, the term of this patent is extended or adjusted under 35 U.S.C. 154(b) by 0 days.

(21) Appl. No.: 09/971,390

(22) Filed: Oct. 4, 2001

(51) Int. Cl.[7] ..... B42D 15/00
(52) U.S. Cl. ..... 283/67; 283/70; 283/81
(58) Field of Search ..... 283/107, 108, 283/109, 110, 111, 79, 80, 81, 101, 105, 117, 67, 70

(56) References Cited

U.S. PATENT DOCUMENTS 4,993,752 A * 2/1991 Juszak ..... 283/67
5,334,431 A * 8/1994 Longtin ..... 283/81
5,403,025 A * 4/1995 Shanley ..... 283/81
6,416,835 B1 * 7/2002 Preston et al. ..... 283/81

FOREIGN PATENT DOCUMENTS

WO WO 93/07535 * 4/1993 ..... 283/81

* cited by examiner

*Primary Examiner*—Willmon Fridie, Jr.
(74) *Attorney, Agent, or Firm*—Myron Amer, P.C.

(57) ABSTRACT

An informational label prepared to be and thus advantageously attached by static electricity to a wine glass in a restaurant and readily peeled off for transfer to a cooperating wallet surface of the patron to facilitate making subsequent purchasing reference to the label.

2 Claims, 1 Drawing Sheet

STATIC CLING WINE INFORMATION LABEL AND USE

The present invention relates to improvements in providing beverage identification, principally of wine, to restaurant patrons to facilitate subsequent wine purchases, the improvements, more particularly, obviating the need to commit to memory or to write down the informational content of the wine bottle label.

EXAMPLE OF THE PRIOR ART

For proper wine identification, among other complexities, it is necessary to know the grape source, the area and name of the vineyard, the harvest and/or bottling year, the winery attending to the bottling, and like information. In a restaurant environment, even ordering the wine by the bottle and affording a cursory review of its label requires a commitment to memory or a label-duplicating chore which is difficult to accomplish and, of course, ordering the wine by the glass, which often is done, is even less favorable in providing an interested patron with subsequent wine-purchasing information. Exemplary of prior art patents addressing this problem is U.S. Pat. No. 5,380,045 for Method For Identifying An Object And The Resulting Structure issued to Comann on Jan. 10, 1995, in which provision is made for a removable reminder label from the wine bottle to be provided the restaurant patron which duplicates the informational content of the wine bottle label. While useful to the one recipient, if several patrons are being served which typically is the case for wine ordered by the bottle rather than by the glass, the information has to be subsequently shared or duplicated at the restaurant. Moreover, the necessarily diminutive size of the reminder label is often "lost" amongst the personal effects typically carried in a wallet or handbag.

Broadly, it is an object of the present invention to provide as a restaurant amenity a wine-specifying take-home label overcoming the foregoing and other shortcomings of the prior art.

More particularly, it is an object to provide in a restaurant environment a wine (and cocktail liqueur) identifying label advantageously displayed on the serving glass and readily transferable to a take-home object of the patron for subsequent wine-purchasing use, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
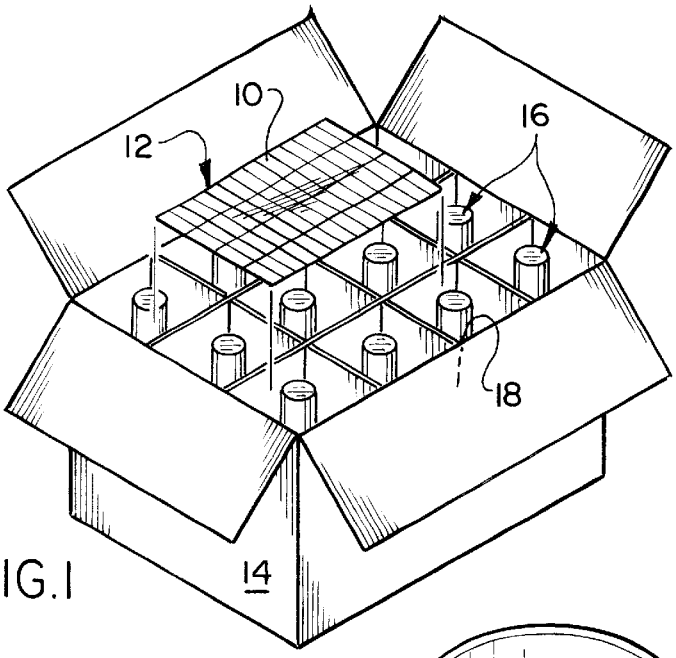
FIG. 1 is a perspective view of a carton constituting a typical wine delivery to a restaurant.
Figure 2:
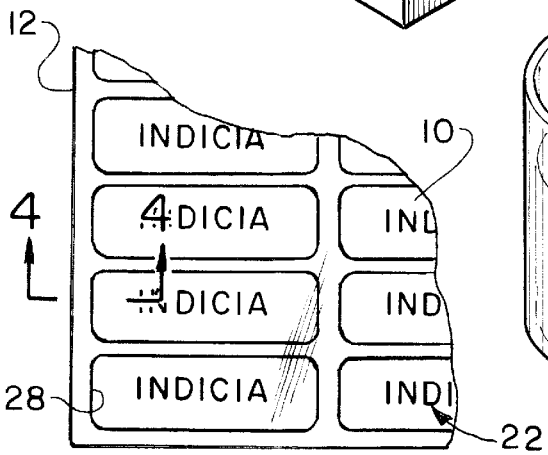
FIG. 2 is a front view of a partial sheet of wine informational labels that would accompany the wine delivery of FIG. 1 according to the present invention.
Figure 6:
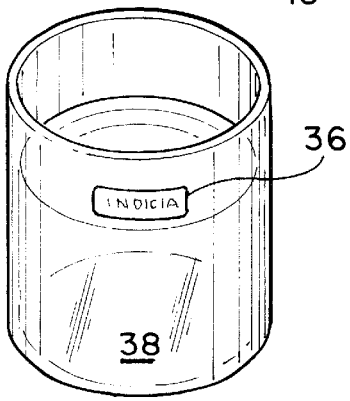
FIGS. 5 and 6 are perspective views of the labels in a restaurant environment on a wine glass (FIG. 5) and on a cocktail glass (FIG. 6)
Figure 5:
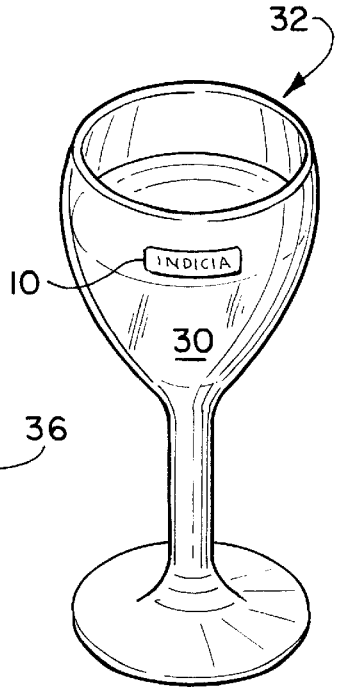
Figure 3:
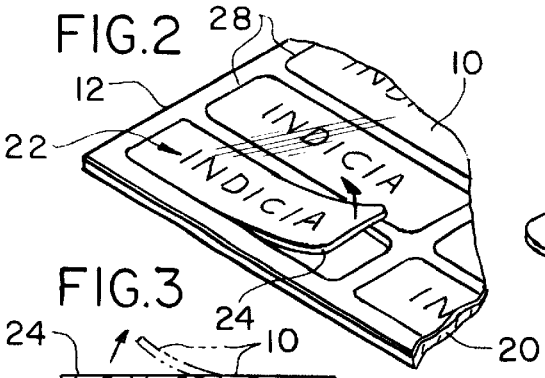
FIG. 3 is a perspective view of the labels of FIG. 2 showing further details.

As known from common experience, restaurant patrons pleased with a served wine (or cocktail) often would like to duplicate the experience again at a restaurant, or at home, but forget the identification of the wine. The focus of the present invention is a wine information label, individually and collectively designated 10, which would be supplied on a sheet format, as noted at 12, in the delivery carton 14 containing labeled bottles of wine, individually and collectively designated 16. Since for all intent and purposes, each bottle 18 is "permanently" labeled by adhesive to the bottle with typically the name of the vineyard, the year of the wine, the type of wine (for example, Chardonnay, Riesling, Cabernet Sauvignon or Rose) and the year (for example 1986, 1987) and also, but less typically, with other information if desired such as the name of the restaurant serving the wine, the location of distributors who sell the wine or a telephone number at which such information can be obtained for subsequent use by the restaurant patron, it is necessary that the content of the wine label has to be copied which is tedious and often too much of a chore. For the winery or vineyard supplier of the wine 16, however, the prospect of increasing sales of the wine is ample motivation for supplying the wine informational labels 10 on peel off sheet substrates 20 having indicia 22 imprinted on the label duplicating the content of the wine bottle label, either separately or in the delivery carton 14.

Figure 4:
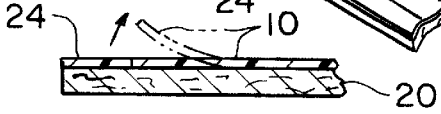
FIG. 4 is a sectional view of the labels and supporting substrate as taken along line 4—4 of FIG. 2.

To facilitate use of the label 10 at the restaurant, in a preferred embodiment, it will be understood that the label is a relatively thin sheet 24 of an optically transparent, static cling vinyl material which is dimensioned to cover the entire surface 26 of the substrate 20 and is electrostatically adhered thereto. The sheet 24 is preferably formed of a polyvinyl chloride material and is manufactured by a calendering process as is well known in the art. The obverse surface of the vinyl sheet 24 is imprinted with indicia 22 and the vinyl sheet 24 is then die cut, as at 28 along the outlines of the indicia 22 to form a plurality of labels which can be manually peeled from the surface 26 separating surrounding vinyl sheet 24 along the die cut liens lines 28, as indicated in FIG. 4.

Figure 7:
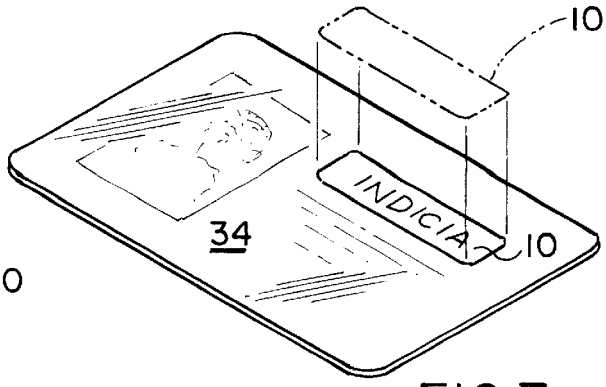
FIG. 7 illustrates in perspective use of a label in a take-home mode.

As used in the restaurants, a label 10 is attached using its static cling attraction to the glass surface 30 of a wine glass 32, and is readily removed for subsequent reference and transferred to an object on the patron's person, such as a plastic credit card 34 (FIG. 7) or to a protective plastic cover typically used over a driver's license in a wallet (not shown).

In similar fashion, an appropriately prepared label 36 can be used on a cocktail glass 38 indicating a brand of the liquid, such as a vodka or the like, which although not as likely to be forgotten by a patron is nevertheless an appreciated amenity. Also, the display on the glass 38 during restaurant use contributes to advertising value to the use of restaurant display labels according to the present invention.

While a static cling restaurant used and take-home label herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of preparing a wine informational label for transport from a restaurant with a restaurant patron comprising the steps of calendering a substrate in a label format of polyvinyl chloride construction material having a front surface and an obverse surface so as to induce a static charge therein, imprinting said obverse surface with indicia of a selected content identifying a bottle source of a selected wine, providing an initial operative position of said label with said obverse surface thereof in a static-induced attachment to a surface of a wine glass in a restaurant environment, filling said wine glass with wine having an informational relation to said indicia imprinted on said label obverse surface, removing said label from said wine glass, and providing a subsequent operative position of said label on a plastic surface available to said restaurant patron in a duplicated static-induced attachment thereto, whereby said label undergoes transport with said restaurant patron to contribute to subsequent use of said informational content of the label.

2. A method of preparing a cocktail informational label for transport from a restaurant with a restaurant patron comprising the steps of calendering a substrate in a label format of polyvinyl chloride construction material having a front surface and an obverse surface so as to induce a static charge therein, imprinting said obverse surface with indicia of a selected content identifying a bottle source of a selected cocktail, providing an initial operative position of said label with said obverse surface thereof in a static-induced attachment to a surface of a cocktail glass in a restaurant environment, filling said cocktail glass with a cocktail having an informational relation to said indicia imprinted on said label obverse surface, removing said label from said cocktail glass, and providing a subsequent operative position of said label on a plastic surface available to said restaurant patron in a duplicated static-induced attachment thereto, whereby said label undergoes transport with said restaurant patron to contribute to subsequent use of said informational content of the label.

* * * * *